US009631525B2

(12) United States Patent
Oppel et al.

(10) Patent No.: US 9,631,525 B2
(45) Date of Patent: Apr. 25, 2017

(54) CAM PHASER WITH ELECTROMAGNETICALLY ACTUATED HYDRAULIC VALVE

(71) Applicant: Hilite Germany GmbH, Marktheidenfeld (DE)

(72) Inventors: Michael Oppel, Neuendorf (DE); Matthias Lang, Roden-Ansbach (DE); Marc Hohmann, Marktheidenfeld (DE)

(73) Assignee: Hilite Germany GmbH, Marktheidenfeld (DE)

( * ) Notice: Subject to any disclaimer, the term of this patent is extended or adjusted under 35 U.S.C. 154(b) by 5 days.

(21) Appl. No.: 14/696,470

(22) Filed: Apr. 26, 2015

(65) Prior Publication Data

US 2015/0330267 A1 Nov. 19, 2015

Related U.S. Application Data

(63) Continuation of application No. PCT/DE2013/200300, filed on Nov. 14, 2013.

(30) Foreign Application Priority Data

Nov. 16, 2012 (DE) ..... 10 2012 111 033

(51) Int. Cl.
*F01L 1/344* (2006.01)

(52) U.S. Cl.
CPC ..... *F01L 1/3442* (2013.01); *F01L 2001/3443* (2013.01); *F01L 2001/3445* (2013.01);
(Continued)

(58) Field of Classification Search
CPC ..... F01L 1/3442; F01L 2001/34423; F01L 2001/34426; F01L 2001/3445; F01L 2001/34483
(Continued)

(56) References Cited

U.S. PATENT DOCUMENTS

2011/0220046 A1* 9/2011 Welte ..... F01L 1/3442 123/90.15
2011/0309281 A1* 12/2011 Hoppe ..... F01L 1/34 251/324
2012/0073535 A1* 3/2012 Hoppe ..... F01L 1/34 123/188.4

FOREIGN PATENT DOCUMENTS

DE 102006012775 b4 9/2007
DE 102007012967 B4 9/2008
(Continued)

*Primary Examiner* — Jorge Leon, Jr.
(74) *Attorney, Agent, or Firm* — Von Rohrscheidt Patents

(57) ABSTRACT

A cam phaser including an electromagnetically actuated hydraulic valve; and a hollow piston inserted in a borehole and longitudinally movable by an electromagnet so that a hydraulic fluid is distributed to operating connections associated with pressure cavities of the cam phaser, wherein a first operating connection branches off from a borehole directly adjacent to the electromagnet, wherein the hollow piston includes a circumferential bar with a control edge oriented towards the electromagnet so that a cavity within the borehole is defined on one side by the circumferential bar and on another side by the electromagnet, wherein a drain opening extends from the cavity, wherein the drain opening hydraulically connects the cavity with a drain channel leading towards a tank drain, wherein the bar is movable into a direction expanding the first operating connection in the flow cross section by a force of the electromagnet that is loaded with electrical current.

9 Claims, 6 Drawing Sheets

(52) U.S. Cl.
CPC ..... *F01L 2001/34423* (2013.01); *F01L 2001/34426* (2013.01); *F01L 2001/34433* (2013.01); *F01L 2001/34483* (2013.01)

(58) Field of Classification Search
USPC ..... 123/90.15
See application file for complete search history.

(56) References Cited

FOREIGN PATENT DOCUMENTS

| | | | |
|---|---|---|---|
| DE | 102006012733 | B4 | 11/2009 |
| DE | 102010023864 | | 12/2011 |
| EP | 1476642 | | 11/2004 |
| WO | WO03067034 | A1 | 8/2003 |

* cited by examiner

CAM PHASER WITH ELECTROMAGNETICALLY ACTUATED HYDRAULIC VALVE

RELATED APPLICATIONS

This application is a continuation of International application PCT/DE2013/200300, filed on Nov. 14, 2013 and claiming priority from German application DE 10 2012 111 033.6 filed on Nov. 16, 2012, both of which are incorporated in their entirety by this reference.

FIELD OF THE INVENTION

The invention relates to a cam phaser with an electromagnetically actuated hydraulic valve according to the single piece portion patent claim 1.

BACKGROUND OF THE INVENTION

A cam phaser with a hydraulic valve is already known from DE 2006 012 733 B4 and DE 10 2006 012 755 B4. In this printed document cam switching moments are also described.

In order to provide high control quality also in combustion engines with highly variable cam switching torques DE 10 2010 014 500 provides that a shifting position of the hydraulic valve is proportionally controllable in which shifting position pressure spikes of the operating connection that is to be unloaded are blocked towards the supply connection and the operating connection to be loaded.

A hydraulic valve for a cam phaser is already known from EP 1 476 642 B1 wherein the hydraulic valve includes two hollow pistons which are supported at one another through a coil spring.

Thus, a gap between the two hollow pistons is openable and closeable.

BRIEF SUMMARY OF THE INVENTION

Thus, it is an object of the invention to provide a cam phaser with high regulation quality.

This object is achieved by a cam phaser including an electromagnetically actuated hydraulic valve; and a hollow piston inserted in a borehole and longitudinally movable by an electromagnet so that a hydraulic fluid is distributed to operating connections associated with pressure cavities of the cam phaser, wherein a first operating connection branches off from a borehole directly adjacent to the electromagnet, wherein the hollow piston includes a circumferential bar with a control edge oriented towards the electromagnet so that a cavity within the borehole is defined on one side by the circumferential bar and on another side by the electromagnet, wherein a drain opening extends from the cavity, wherein the drain opening hydraulically connects the cavity with a drain channel leading towards a tank drain, wherein the bar is movable into a direction expanding the first operating connection in the flow cross section by a force of the electromagnet that is loaded with electrical current, wherein a spring force is oriented opposite to the force and presses the bar in a direction reducing the flow cross-section, and wherein a throttling location is provided at the bar which throttling location is arranged between the flow cross-section and the cavity.

According to the invention when reducing a current at electromagnet of the hydraulic valve draining the hydraulic fluid from the pressure cavity to the tank drain is already commenced rather early. Furthermore the characteristic curve which shows volume flow of this draining over electrical current is rather linear.

Thus, the cam phaser includes two operating connections A, B. The first operating connection A is directly adjacent to the electromagnet. A hollow piston that is axially moveable in a bore hole has a circumferential bar with a control edge oriented towards the electromagnet. Thus, a cavity is formed within the bore hole which is defined on one side by the bar at the hollow piston and on the other side by the electromagnet. The hydraulic fluid can be run from this cavity through a drain opening in the hollow piston to a tank drain T. However, in a hydraulic valve that is not configured according to the invention the cam phaser, for example due to cam switching torques, could be prone to press more hydraulic fluid into the cavity than can be pressed out of the cavity through the recess. Then the hollow piston might not move towards the cavity that is under a rather high pressure from the first operating connection when the current at the electromagnet is reduced quickly. This means the hollow piston may not follow the electromagnet and a gap might open. Due to a lack of movement of the hollow piston the flow cross section at the operating connections may not change either. For this reason a throttling location is provided according to the invention between the first operating connection A and the cavity. Since the hydraulic fluid is only provided from the operating connection A in a small amount the cavity can unload through the recess more quickly and the draining towards the tank drain is performed earlier. The characteristic curve which represents the flow of this draining over the electrical current thus extends more linear than without throttling location. Thus a precise regulation is facilitated.

The cam switching torques are the stronger, the lower a number of cylinders per cam shaft, this means per cylinder bank. Thus, the invention is particularly advantageous for three cylinder engines and V-6 engines. The invention can also be used with other engines.

In a particularly advantageous embodiment a pump check valve is provided. Pressure spikes coming from cam shifting torques are supported at the pump check valve. Thus, the check valve can be provided as band shaped check valve which is inserted into a ring cavity or a ring groove of the hydraulic valve. For example it is also feasible to provide the check valve as a ball check valve in a funnel shaped valve seat like the ball check valve that is already known from DE 10 2007 012 967 B4.

In an advantageous embodiment of the invention the hydraulic valve is provided as a central valve. A central valve of this type has installation space advantages. Besides the central valves there are non-central or external valves for actuating the cam phaser. For an external hydraulic valve the hydraulic channels for cam adjustment run from the cam phaser to a separate control cover with the hydraulic valve threaded into it or to the cylinder head with the hydraulic valve threaded into it. Conduction losses are associated with the hydraulic conductors from the cam phaser to the external hydraulic valve. Furthermore, control inputs are not executed by the external hydraulic valve in the same dynamic manner as they are executed by the central valve. The hydraulic central valve is arranged radially inside the rotor hub of the cam phaser.

In another advantageous embodiment of the invention, a second throttling location is arranged at the second operating connection B. Per definition, the second throttling location is less effective than the first throttling location. Namely at the first throttling location, the hollow piston is pressure balanced when the connection sequence is A-B-T1-P. Without this second throttling location, the hollow piston, however, would be moved very rapidly towards the electromagnet when opening from the second operating connection B towards the tank drain T1, The second throttling location, however, causes a delay in this case so that regulation of the hydraulic valve is improved.

BRIEF DESCRIPTION OF THE DRAWINGS

Further advantages of the invention can be derived from the dependent claims, the description and the drawing figures. The invention is subsequently described in more detail with reference to an advantageous embodiment, wherein:

DETAILED DESCRIPTION OF THE INVENTION

Figure 1:
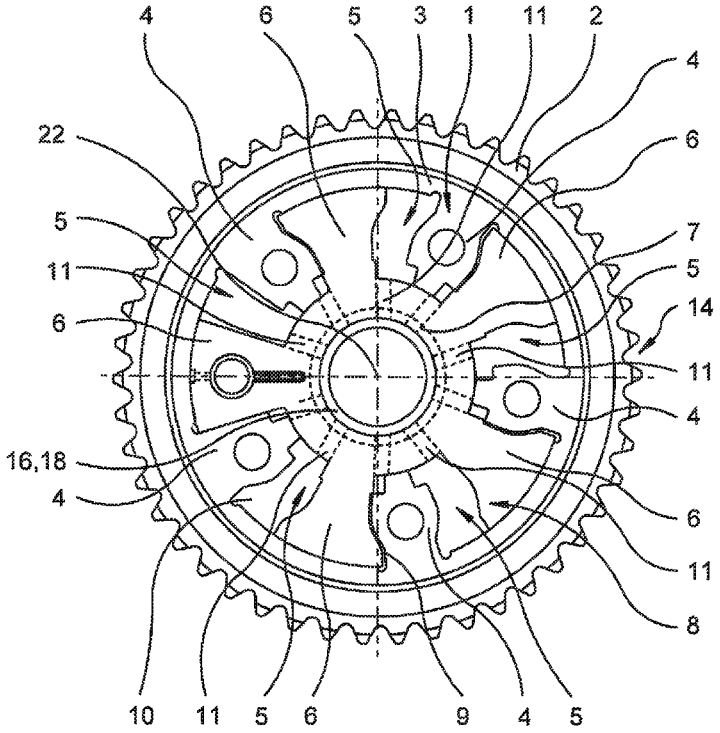
FIG. 1 illustrates a cam phaser in a sectional view.

A cam phaser 14 according to FIG. 1 adjusts an angular position of a cam shaft 18 relative to a drive gear 2 continuously during operation of an internal combustion engine. A relative rotation of the cam shaft 18 moves opening and closing times of gas control valves so that the internal combustion engine delivers optimum power at a given speed. The cam phaser 14 includes a cylindrical stator 1 which is connected torque proof with the drive gear 2. In the embodiment, the drive gear 2 is a chain sprocket over which a chain is run that is not illustrated in detail. However, the drive gear 2 can also be a timing belt cog over which a timing belt is run as a drive element. The stator 1 is drive connected through this drive element and through the drive gear 2 with the crank shaft.

The stator 1 includes a cylindrical stator base element wherein bars 4 protrude radially inward with equidistant spacing at an inside of the stator base element. Between adjacent bars 4 intermediary spaces 5 are formed into which a pressure medium is introduced through a hydraulic valve 12 that is illustrated in more detail in FIG. 2. Thus, the hydraulic valve 12 is configured as a central valve. Between adjacent bars 4, blades 6 protrude which extend radially outward from a cylindrical rotor hub 7 of a rotor 8. These blades 6 divide the intermediary spaces 5 between the bars 4 respectively into two pressure cavities 9 and 10.

The bars 4 contact an outer enveloping surface of the rotor hub 7 in a sealing manner with faces of the bars. The blades 6 in turn contact the cylindrical inner wall of the stator base element 3 with their faces in a sealing manner.

The rotor is connected torque proof with the cam shaft 18. in order to change the angular position of the cam shaft 18 relative to the drive gear 2, the rotor 8 is rotated relative to the stator 1. For this purpose, the pressure medium in the pressure cavities 9 or 10 is pressurized as a function of the desired direction of rotation, whereas the respective other pressure cavities 10 or 9 are unloaded towards the tank. in order to pivot the rotor 8 relative to the stator 1 counter clockwise into the illustrated position a first annular rotor channel in the rotor hub 7 is pressurized by the hydraulic valve 12. from this first rotor channel additional channels 11 lead into the pressure cavities 10. The first rotor channel is associated with the first operating connection A. in order to pivot the rotor 8 clockwise, a second annular rotor channel in the rotor hub 7 pressurized by the hydraulic valve 12. This second rotor channel is associated with the second operating connection B. The two rotor channels are arranged axially offset from one another with respect to a central axis 22.

The cam phaser 14 is placed onto the cam shaft 18 that is configured as a hollow tube 16. For this purpose the rotor 8 is slid onto the cam shaft 18. The cam phaser 14 is pivotable by the hydraulic valve 12 illustrated in FIG. 2.

A bushing 15 that is associated with the hydraulic valve 12 is coaxially inserted in the hollow tube 16. A hollow piston 19 is supported axially movable in the central bore hole 85 of the bushing 15 against a force of a compression coil spring 24. The compression coil spring 24 is supported on one side at the hollow piston 19 and on another side at the housing. A ring 88 with a spring base support is pressed into the hollow piston 19 so that the ring provides a contact for the compression coil spring 24. The compression coil spring 24 is supported in a radial spring support 103 in the hollow piston 19.

The radial spring support 103 is provided on an outside as a second bar 112 out of two bars 102, 112. This second bar 112 facilitates changing a flow cross section of the second operating connection B.

A plunger 20 of an electromagnet 100 contacts the hollow piston 19.

Figure 2:
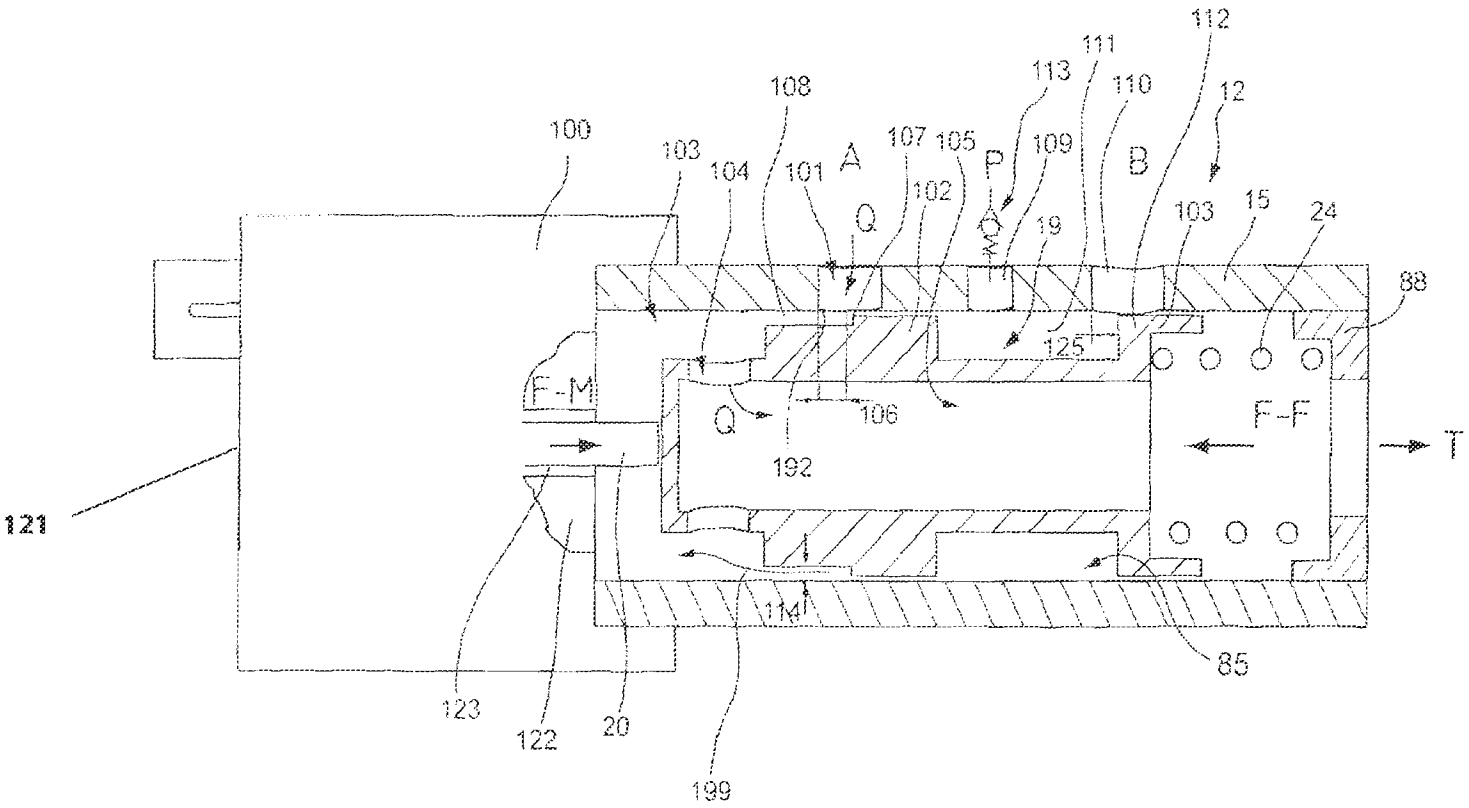
FIG. 2 illustrates a semi-sectional view of a hydraulic valve for adjusting the cam phaser according to FIG. 1, wherein the hydraulic valve includes a throttling location.

FIG. 2 illustrates a position in which the hollow piston 19 is disposed when the electromagnet 100 is loaded with a maximum current. In this case the second operating connection B is supplied with hydraulic pressure by a supply connection P which is arranged between the two operating connections A, B. The hydraulic fluid flows through a control groove 111 which is axially arranged between the two bars 102, 112. in return the hydraulic fluid is run out of a pressure cavity 9 associated with the first operating connection A through

- a flow cross-section 106 at a transversal bore hole 101,
- a throttling location 108,
- a cavity 103 within the bushing 15,
- a drain opening 104 in the hollow piston 19,
- a drain channel 105 in the hollow piston 19,
- to a tank drain T.

The two operating connections A, B and the supply connection P are configured as transversal bore holes 101, 109, 110 in the bushing 15 that are axially offset from one another. The drawing only illustrates one respective transversal bore hole 101 or 109 or 110 per connection A, P, B. However, plural transversal boreholes are arranged circumferentially offset from one another per connection A, P, B. The supply connection P runs through a check valve 113 into the center transversal borehole 109 into the control groove 111.

The hollow piston 19 is longitudinally movable in the borehole 85 using the electromagnet 100. Thus, the first operating connection A originates from this borehole 85. This operating connection A is directly adjacent to the electromagnet 100 and originates from the borehole 85. The transversal borehole 101 associated with this first operating connection A is associated with a first bar 102 that circumferentially extends at the hollow piston 19. This bar 102 includes a control edge 107 oriented towards the electromagnet 100. Thus, the cavity 103 within the borehole 85 is defined on one side by the bar 102 and on the other side by the electromagnet 100. Between the bar 102 and the electromagnet 100 the drain opening 104 is provided in the hollow piston 19. This drain opening 104 hydraulically connects the cavity 103 with the drain channel 105 leading towards the tank drain T within the hollow piston 19. The bar 102 at the first operating connection A is movable by a force F-M of the current loaded electromagnet 100 in a direction so that the first operating connection A in the flow cross-section 106 is expanded. This flow cross-section 106 is formed between the control edge 107 and an inner edge of the transversal borehole 101. The force F-M is directed against a spring force F-F which moves the bar 102 into a direction reducing the flow cross-section. A throttling location 108 is provided at the bar 102 wherein the throttling location is arranged between the flow cross-section 106 and the cavity 103.

When the hollow piston 19 is moved by the compression coil spring 24 into another non illustrated end position due to a decrease of the force F-M at the plunger 20 of the electromagnet 100 the hydraulic fluid is conducted from the supply connection P to the first operating connection A. Thus, the hydraulic fluid flows from the supply connection P or its transversal borehole 109 through the control groove 111 into the transversal borehole 101 of the first operating connection A, In return the hydraulic fluid is drained from the pressure cavities 10 associated with the second connection B through the transversal borehole 110 released by the bar 112 towards the tank drain T.

Furthermore, the hollow piston 19 can also be regulated into a central locking position in which both operating connections A, B are loaded with more pressure than can be relieved by the hydraulic fluid. This fixates the cam phaser 14 in this angular position.

A housing component 121 of the electromagnet is fixated at a component wherein the borehole 85 is fabricated in the component. In the instant embodiment, the component is implemented as a bushing 15.

The electromagnet 100 includes the plunger 20. The plunger 20 contacts the hollow piston 19 and is run through an opening 123 in a pole core 122 of the electromagnet 100. This opening 123 facilitates an exchange of hydraulic fluid between the electromagnet 100 and the cavity 103. When the plunger 20 is extended hydraulic fluid flows into the electromagnet 100. However, when the plunger 20 is retracted, hydraulic fluid flows out of the electromagnet 100 into the cavity 103.

The throttling location 108 is implemented as a very thin annular gap 114. The annular gap 114 adjoins the bar 102. This throttling location 108 has the effect that a pressure decreases rapidly towards the cavity 103 when a high pressure is applied to the first operating connection A. When the force F-M of the electromagnet 100 is reduced, the hydraulic fluid can be drained from the space 103 through the drain opening 104 towards the tank drain without the amount of drained hydraulic fluid being replenished from the operating connection A immediately. The hollow piston 19 can follow the plunger 20 early when the force F-M is reduced. The early movement of the bar 102 also reduces the flow cross section 106 early.

Figure 4:
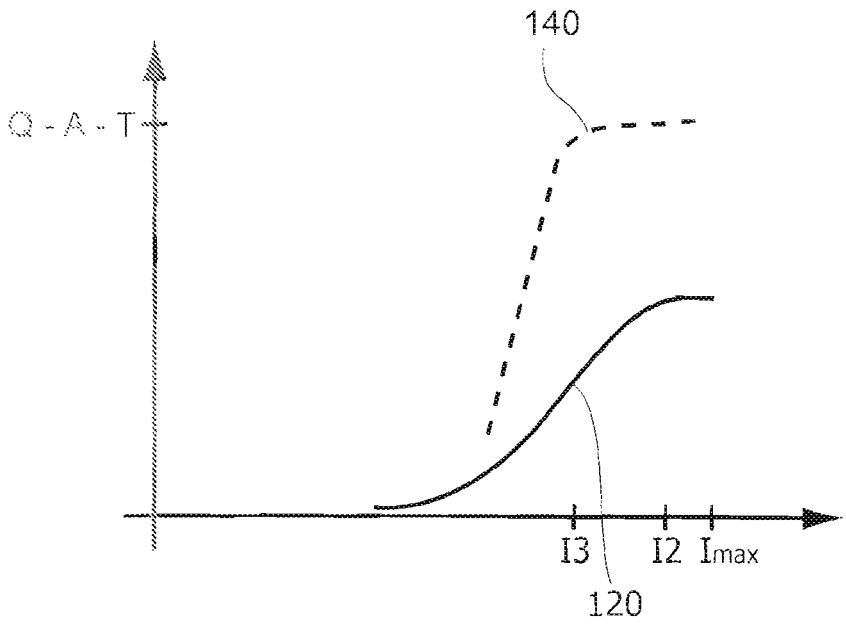
FIG. 4 illustrates a diagram which compares a characteristic curve of the hydraulic valve according to FIG. 2 with a characteristic curve of the hydraulic valve according to FIG. 3.

The characteristic curve 120 of the hydraulic valve 12 is illustrated in FIG. 4. This characteristic curve is illustrated in a diagram which illustrates the volume flow Q-A-T from the first operating connection A to the tank drain T over the amount of electrical current applied to the electromagnet 100. The maximum current Imax in FIG. 4 represents the right end of the characteristic curve 120.

Figure 3:
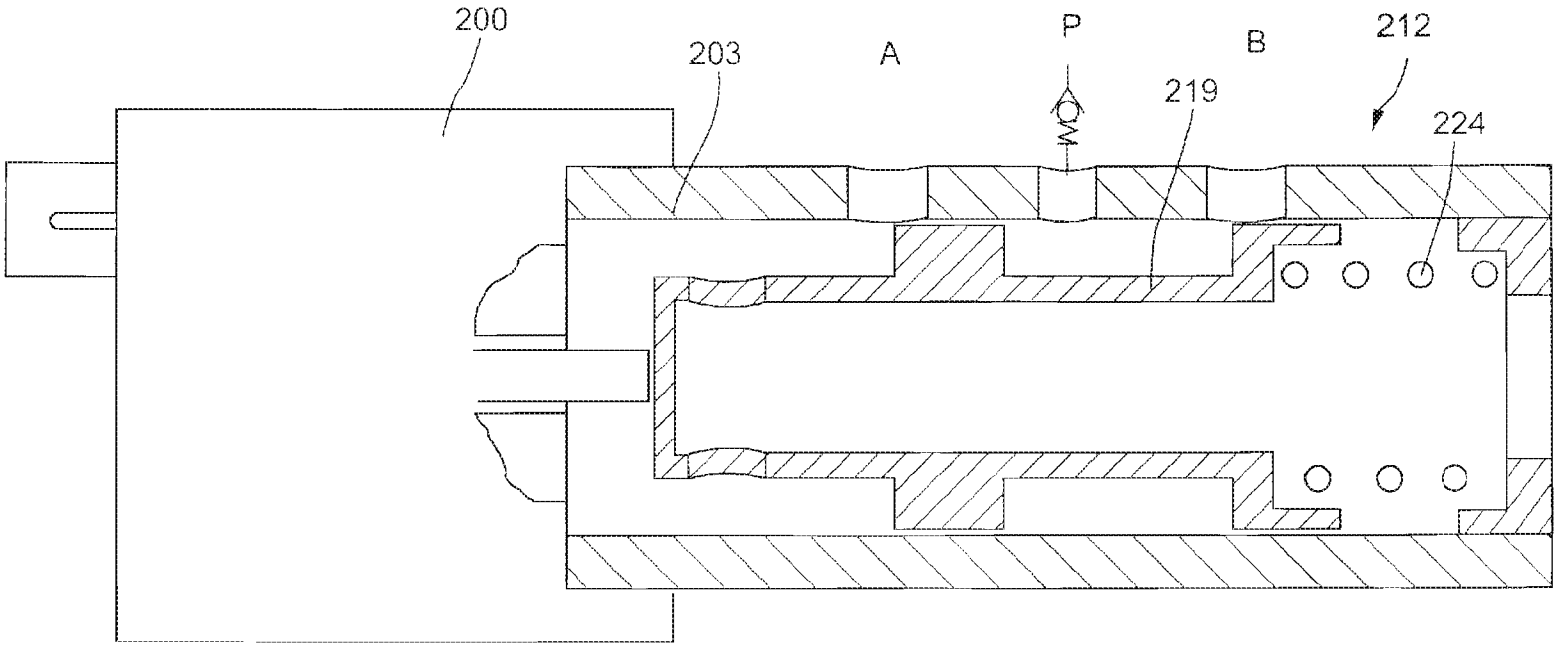
FIG. 3 illustrates a semi-sectional view of a hydraulic valve without the throttling location according to the invention.

The dashed characteristic curve 140 however, illustrates the behavior of a hydraulic valve 212 which is illustrated in FIG. 3. In this hydraulic valve 212 no throttling location 108 is provided, When a current decreases from Imax to 12 in an electromagnet 200 of the hydraulic valve 212 the magnetic force F-M decreases. However, the hollow piston 219 does not move yet since the hollow piston 219 cannot displace the hydraulic fluid out of the cavity 203 since the hydraulic fluid from the first operating connection A presses behind it. Thus, the force due to the pressure conditions in the cavity 203 plus the magnetic force F-M of the electromagnet 200 is even greater than the spring force F-F of the compression coil spring 224, At a current 13, the magnetic force has decreased far enough so that the hollow piston 19 begins to move. With this movement the flow cross-section 106 at the first operating connection A is also reduced.

Figure 5:
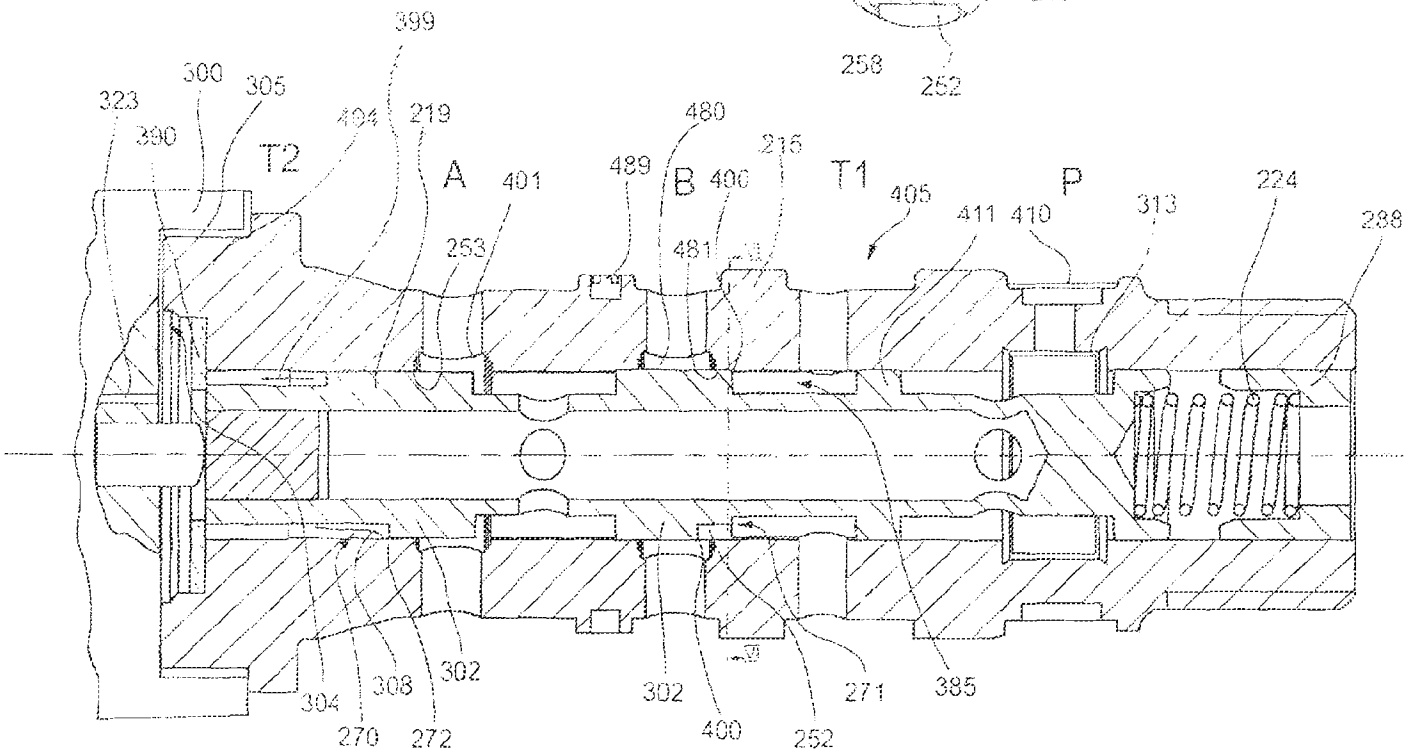
FIG. 5 illustrates an alternative embodiment of the hydraulic valve configured as a central threaded bolt.

FIG. 5 illustrates the hydraulic valve in an alternative embodiment configured as a central threaded bolt 405. Thus, a position is illustrated in which the hollow piston 19 is disposed when the electromagnet 300 is not loaded with current. Thus, the first operating connection A is provided with hydraulic pressure through a hollow piston 419 from a supply connection P disposed axially adjacent to the two operating connections A, B and a first tank drain T1. The hydraulic fluid thus runs through a filter 410 and a check valve 313 which is band shaped. The check valve 313 is inserted into an inner annular groove of the borehole 385 of the central threaded bolt 405. Thus, the borehole 385 extends in the central threaded bolt 405 which includes a bolt head 404. A drain opening 304 is provided in a portion of the threaded bolt head 404. The drain channel 305 is thus formed between the threaded bolt head 404 and the electromagnet 300. The drain opening 304 leads to the second tank drain T2 which forms a joint tank drain T together with the first tank drain T1.

Figure 6:
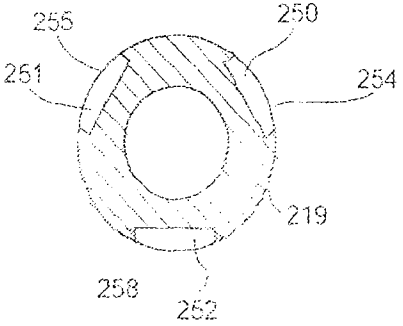
FIG. 6 illustrates a sectional view along a line VI-VI of FIG. 5 and FIG. 7 of the hollow piston.

The throttling location 308 is configured as a circumferentially defined material recess 270 cut out of the bar 302. Thus, plural circumferentially defined material recesses 270 are provided at the circumference of the bar 302. An even distribution of the arrangement of the plural material recesses 270 can be analogously derived from FIG. 6. Thus, FIG. 6 illustrates a second throttling location 271 which is arranged in FIG. 5 in the portion of the line VI-VI.

The first operating connection A includes an inner ring groove 401 whose first edge 253 forms the flow cross-section together with an edge 272 of the respective material recess 270.

Figure 7:
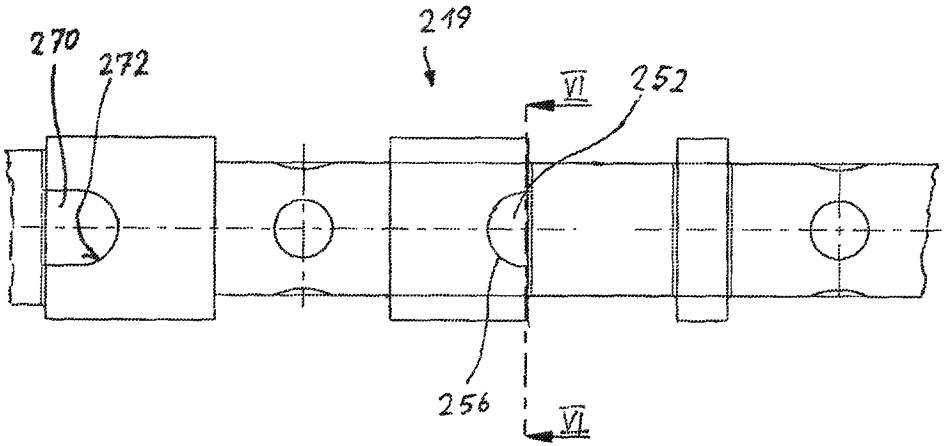
FIG. 7 illustrates a detail of the hollow piston in a top view.

It is evident from FIG. 7 that the material recess 270 is rounded. Thus, an even opening of the flow cross-section is provided instead of an instantaneous opening.

The first operating connection A is arranged between the second operating connection B and the electromagnet 300. The hollow piston 219 includes a second circumferential bar 302 with a control edge 400 oriented away from the electromagnet 300. This control edge 400 can vary a flow cross-section towards the tank drain T1. At the second bar 302 the previously recited second throttling location 271 is provided which leads to the tank drain T1.

FIG. 6 illustrates the material recesses 250, 251, 252 spaced equidistant over the circumference. The second operating connection B includes an inner annular groove 480 whose one edge 481 forms the second flow cross-section together with an edge 254 or 255 or 256 of the respective material recess 250, 251, 252.

As a matter of principle, the second throttling location 271 is less effective than the first throttling location 308. Namely in the second throttling location 271 the hollow piston 219 is pressure balanced since a pressure loadable surface at a third bar 411 is arranged apposite to the pressure loadable annular surface at the second bar 302. Without this second throttling location the hollow piston 219 would be moved very rapidly in a direction towards the electromagnet 300 when opening the second operating connection B towards the first tank drain T1. The second throttling location, however, causes a delay so that regulation properties of the hydraulic valve are improved.

The central threaded bolt 405 includes a seal 481 which seals the first operating connection A relative to the second operating connection B.

Thus no plunger is required. The hollow piston can also contact an armature of the electromagnet directly.

Instead of the compression coil spring for the hollow piston or the compression coil springs for the check valve, disc springs can be used as well.

In an alternative embodiment the rotor 8 can be preloaded in rotation relative to the stator 1 by a compensation spring.

The described embodiments are only exemplary. A combination of the described features to form different embodiments is also feasible. Additional, in particular non-described features of components of the device according to the invention can be derived from geometries of the components illustrated in the drawing figure.

What is claimed is:

1. A cam phaser, comprising:

an electromagnetically actuated hydraulic valve; and a hollow piston inserted in a borehole and longitudinally movable by an electromagnet so that a hydraulic fluid is distributed to a first operating connection and a second operating connection associated with a first pressure cavity and a second pressure cavity of the cam phaser, wherein the first operating connection branches off directly adjacent to the electromagnet from the borehole, wherein the hollow piston includes a circumferential bar with a control edge oriented towards the electromagnet so that a cavity within the borehole is defined on one side by the circumferential bar and on another side by the electromagnet, wherein a drain opening extends from the cavity, wherein the drain opening hydraulically connects the cavity with a drain channel leading towards a tank drain, wherein the circumferential bar is movable into a direction expanding the first operating connection in a flow cross section by a force of the electromagnet that is loaded with electrical current, wherein a spring force is oriented opposite to the force of the electromagnet and presses the bar in a direction reducing the flow cross-section, wherein a throttling location is provided at the circumferential bar which throttling location is arranged between the flow cross-section and the cavity, wherein the throttling location restricts a flow from the flow cross section into the cavity when the flow cross section is opened by the control edge, wherein the throttling location is configured as an annular gap that adjoins the bar, and wherein an axial length of the annular gap is greater than a radial thickness of the annular gap.

2. The cam phaser according to claim 1, wherein the drain opening is provided in the hollow piston between the bar and the electromagnet, wherein the drain opening hydraulically connects the cavity with the drain channel in the hollow piston, which drain channel leads towards the tank drain.

3. The cam phaser according to claim 1, wherein a second bore hole extends within a central threaded bolt including a threaded bolt head, and wherein the drain opening is provided in a portion of the bolt head.

4. The cam phaser according to claim 3, wherein a second drain channel is formed between the bolt head and the electromagnet.

5. The cam phaser according to claim 1, wherein a housing component of the electromagnet is fixated at a component in which the bore hole is fabricated.

6. The cam phaser according to claim 1, wherein the electromagnet includes a plunger which contacts the hollow piston and which extends through an opening in a pole core.

7. The cam phaser according to claim 1, wherein the first operating connection is arranged between the second operating connection and the electromagnet, wherein the hollow piston includes a second circumferential bar with a control edge that is oriented away from the electromagnet, wherein the control edge is configured to vary a flow cross section towards the tank drain, wherein a second throttling location is provided at the second bar, and wherein the second throttling location leads to the tank drain.

8. A cam phaser, comprising:

an electromagnetically actuated hydraulic valve; and a hollow piston inserted in a borehole and longitudinally movable by an electromagnet so that a hydraulic fluid is distributed to a first operating connection and a second operating connection associated with a first pressure cavity and a second pressure cavity of the cam phaser, wherein the first operating connection branches off directly adjacent to the electromagnet from the borehole, wherein the hollow piston includes a circumferential bar with a control edge oriented towards the electromagnet so that a cavity within the borehole is defined on one side by the circumferential bar and on another side by the electromagnet, wherein a drain opening extends from the cavity, wherein the drain opening hydraulically connects the cavity with a drain channel leading towards a tank drain, wherein the circumferential bar is movable into a direction expanding the first operating connection in a flow cross section by a force of the electromagnet that is loaded with electrical current, wherein a spring force is oriented opposite to the force of the electromagnet and presses the bar in a direction reducing the flow cross-section, wherein a throttling location is provided at the circumferential bar which throttling location is arranged between the flow cross-section and the cavity, and wherein the throttling location restricts a flow from the flow cross section into the cavity when the flow cross section is opened by the control edge, wherein the throttling location is configured as at least one axial recess which forms a portion of the control edge of the circumferential bar, and wherein the at least one axial recess extends over less than an entire circumference of the circumferential bar.

9. The cam phaser according to claim 8, wherein the at least on axial recess includes plural axial recesses that are evenly arranged over the circumference of the circumferential bar, and wherein the first operating connection includes an inner annular groove whose edge forms the flow cross section together with an edge of a respective material recess.

* * * * *